United States Patent [19]

Johnson, Jr. et al.

[11] Patent Number: 4,551,126

[45] Date of Patent: Nov. 5, 1985

[54] METHOD OF CARTON FLAP RELAXING

[75] Inventors: A. David Johnson, Jr.; Joseph L. Bachman, Jr., both of Wayne; George E. Ginther, Sr., King of Prussia; Charles E. Zimmermann, Elverson; Albert D. Johnson, Sr., St. Davids, all of Pa.

[73] Assignee: Wayne Automation Corp., Norristown, Pa.

[21] Appl. No.: 550,136

[22] Filed: Nov. 9, 1983

[51] Int. Cl.[4] ..... B31B 1/48

[52] U.S. Cl. ..... 493/453; 493/438; 493/418; 493/397

[58] Field of Search ..... 493/460, 450, 438, 135, 493/480, 418, 131, 332, 453, 396, 397, 398, 399; 162/196; 53/374

[56] References Cited

U.S. PATENT DOCUMENTS

| | | | |
|---|---|---|---|
| 3,198,092 | 8/1965 | Koran | 493/397 |
| 3,826,178 | 7/1974 | Taylor | 493/328 |
| 3,854,917 | 12/1974 | McKinney et al. | 493/418 |
| 4,200,033 | 4/1980 | Labombarde | 493/438 |

OTHER PUBLICATIONS

"Water Jet Folder", A. H. Caudill and W. F. Risedorf, Sep. 1974, 1098–1099.

*Primary Examiner*—Daniel C. Crane
*Assistant Examiner*—David B. Jones
*Attorney, Agent, or Firm*—Frederick J. Olsson

[57] ABSTRACT

Corrugated carton is moved between sprayers which apply water to the score lines of each major end flap and on opposite sides of the score bar about 1" up on the flap and 1" down on the panel. The major flaps are then bent into closed position and while bent, heat is applied to raise the temperature of the wet areas until the same are dry. Then, the bending means and heat are removed. Each end flap assumes a substantially closed position.

9 Claims, 12 Drawing Figures

METHOD OF CARTON FLAP RELAXING

This invention relates in general to the corrugated shipping carton art.

More particularly the invention relates improved methods for relaxing or positioning end flaps of corrugated cartons in a closed position which is far closer to the actual closed position than is attainable with conventional relaxing methods.

Cartons conditioned according to the invention are of special importance to bottle manufacturers involved in both the conventional inverted carton method and the pack and seal method. In both methods bottles are supplied to fillers by way of cartons stacked in tiers on pallets, the cartons containing empty bottles with one set of flaps in theoretically closed position but unsealed. The conventional scoring-wheel method for relaxing the flaps is not satisfactory because in the relaxed position the flaps are too far away from actual closed position. In automatic palletizing, the flap position interferes with stacking the tiers of cartons and also interferes with the inverting of the cartons of the top tier. These problems have caused many fillers to abandon automatic palletizing and resort to costly manual labor.

Also, flaps relaxed by the conventional methods pose a special problem for bottle manufacturers involved in the pack and seal method. In the latter case, the bottle manufacturer inverts the carton with the unsealed flap down and places same on a conveyor to be transported to a case packer. The flaps are so far away from the actual closed position that the cartons are undesirably canted on the conveyor. This results in the flaps snagging on the conveyor rollers or on the side rails and in the flaps failing to contact the conveyor belt. To avoid shutdown because of such problems, fillers must continually supervise an otherwise automatic line with manual labor to detect and correct foul-up. Moreover, where the cartons have partitions, the canting may prevent the guide fingers of the bottle packer from sliding into the proper cell and, thus, result in the shut down of the bottle packer.

One important advantage of the invention is that cartons having flaps relaxed in accordance with the invention resolve both the aforementioned palletizing, conveyor transport, and case packer problems of bottle manufacturers.

Flaps relaxed by the conventional methods not only pose problems for bottle manufacturers involved in the pack and seal method, but also for the filler involved in this method. This method requires the cartons, after being taken off the pallets supplied by the bottle manufacturer, to be placed on a conveyor with unsealed flaps down for delivery to a bottle discharge station. Similarly as mentioned above, the undesirably canted carton causes the flaps to snag on the conveyor roller, on the side rails, and fail to contact the conveyor belt and, thus, supervisors are employed to watch the line.

Another important advantage of the invention is that the above problems of the fillers are eliminated with cartons having end flaps relaxed in accordance to the invention. While solving the above mentioned problems, the invention, by eliminating the palletizing problem, has the advantage of permitting filler and bottle manufacturers to shift away from the relatively slow and expensive inverted carton packing method into the more rapid and less costly pack and seal method. With the inverted carton packing method, the bottle manufacturer must invert the empty bottles for insertion into the cartons, and so there is additional lost time. (In the pack and seal method the bottle manufacturers invert the carton at the time it is erected so there is no lost time.) Bottle inversion increases the packing time because the inverter runs slower when employed in the case packer. Moreover, the bottles are inserted by a discontinuous flow arrangement; i.e. by raising the carton to accept same. This increases the time as compared to a continuous flow arrangement.

Also, bottle inversion creates insertion problems for the bottle manufacturers in connection with insertion of constant diameter or wide mouth bottles such as jars used for mayonaise, peanut butter, etc. With these jars there is no lead arising from the mouth construction as there is in, say a soda bottle. Thus, unless the carton/-partition is correctly oriented, the mouths of the jars will jam on the partition edge and necessitate stoppage of the case packer and further lost time.

The invention involves the concept of relaxing an end flap by wetting the material comprising the score line and adjacent material on opposite sides of the score line and then while the end flap is in closed position raising the temperature of the wet material so that it becomes dry. Thereafter, the flap assumes a substantially closed position which is closer to the actual closed position than attained by the conventional technique.

With the above in mind, we will now describe the invention in connection with the following drawings wherein.

Figure 5:
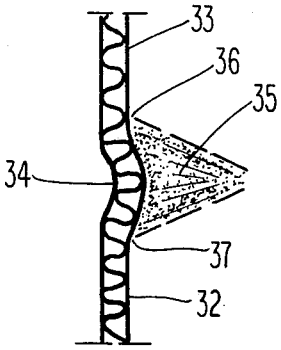
FIG. 5 is a fragmentary sectional view to illustrate applying water via a spray to the outside liner of the carton for an end flap to be relaxed with the flap in open position.
Figure 5A:
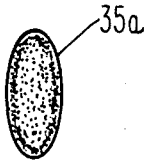
Figure 6:
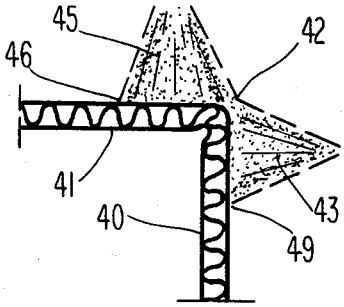
Figure 6A:
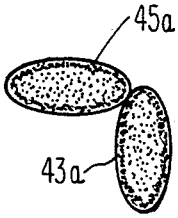
Figure 7:
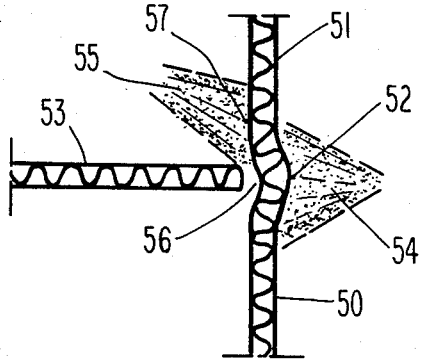
Figure 8:
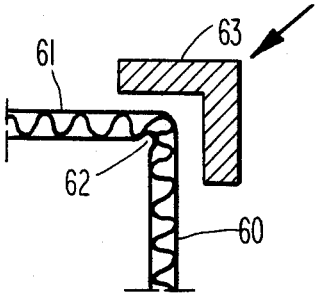
Figure 9:
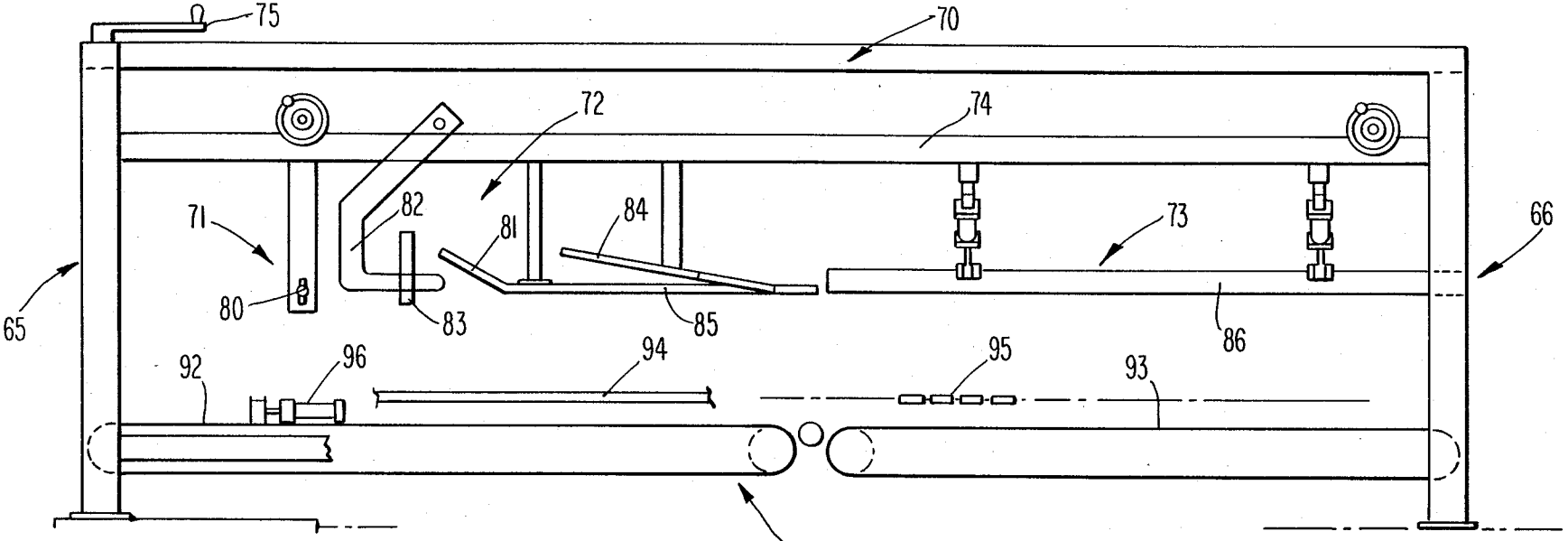
Figure 10:
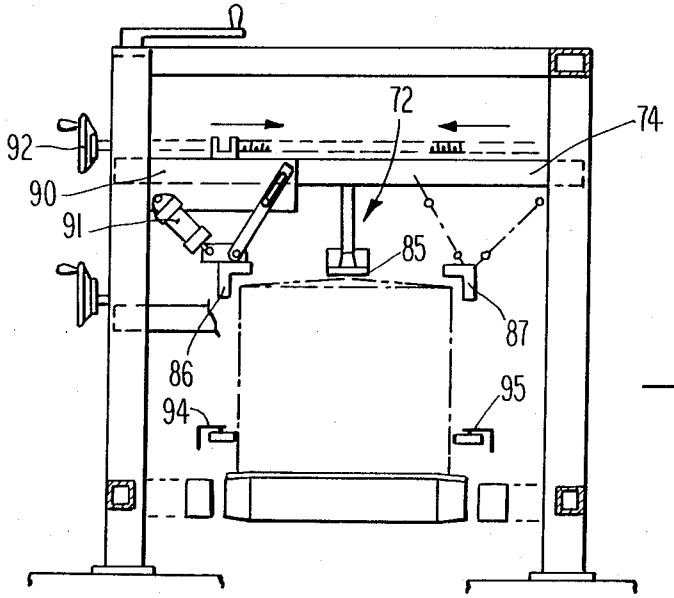

FIG. 5-A is a view to illustrate the spray pattern on the outside liner;

FIG. 6 is a fragmentary sectional view to illustrate applying water via a plurality of sprays to the outside liner of a carton for an end flap to be relaxed with the end flap already in closed position;

FIG. 6-A is a view to illustrate the spraying pattern of FIG. 6;

FIG. 7 is a fragmentary sectional view to illustrate applying water both outside and inside the carton for an end flap to be relaxed;

FIG. 8 is a fragmentary sectional view to illustrate applying heat to the wet area of the carton;

FIG. 9 is a side elevational view to illustrate the arrangement of a machine to carry out the steps of the invention;

FIG. 10 is an end view of the machine of FIG. 9 looking toward the left.

Figure 1:
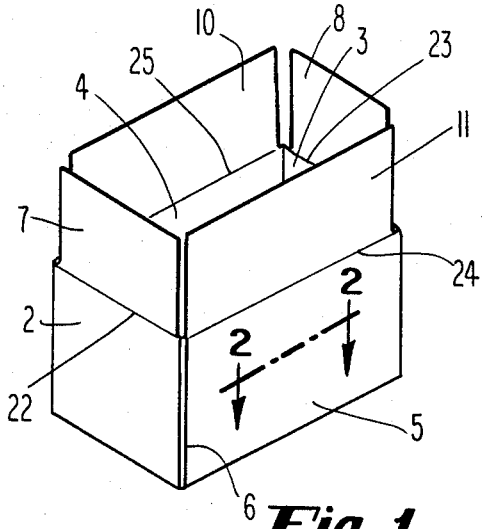
FIG. 1 is a perspective view of a four panel corrugated carton.

FIG. 1 illustrates a typical four panel corrugated shipping carton 1. These cartons are either square or rectangular in shape (as is carton 1) and are sometimes referred to as a RSC or regular slotted carton. Carton 1 has four side panels, the two short (minor) panels indicated at 2 and 3 and the two long (major) side panels indicated at 4 and 5. The panels are connected at manufacturers joint 6. The pair of top end flaps for the panels 2 and 3 are indicated at 7 and 8 and the pair of end flaps for the panels 4 and 5 are indicated at 10 and 11. The bottom of the carton has identical end flaps not shown.

As shown, the end flaps 7, 8, 10, and 11 are in the open position, respectively co-planar with the panels. In the closed position the end flaps are rotated down and inwardly and are oriented at right angles to the respective panels 2, 3, 4, and 5. (The bottom flaps, not shown, are in the closed position.)

Figure 2:
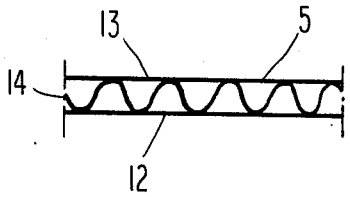
FIG. 2 is a fragmentary cross sectional view of a single thickness carton panel taken as at 2—2 in FIG. 1.
Figure 3:
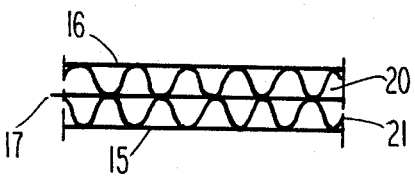
FIG. 3 is a view similar to FIG. 2 and illustrating a double thickness panel.

The above cartons have a panel construction as generally noted in FIGS. 2 and 3. In FIG. 1, this construction comprises an outside paper liner 12 and inside paper liner 13, the liners being connected by corrugated paper medium 14. The bond between the liner and medium 14 is usually comprised of starch. The construction of FIG. 2 is usually referred to as a single wall. The structure of FIG. 3 is usually referred to as double wall. This comprises outside liner 15, inside paper liner 16, intermediate paper liner 16 connected by corrugated paper medium 20 and 21. The liners and mediums are normally joined by a starch bond.

Heavy duty or triple wall cartons include an additional medium and liner.

For purposes of bending the end flap between open and closed positions, the above cartons are provided with so-called score lines at the juncture between the side panels and end flaps. For the end flaps 7, 8, 10, and 11, the score lines are respectively noted at 22, 23, 24, and 25. These score lines are formed as the carton blank is manufactured conventionally by a pair of opposed rollers, one working on the inner liner and the other working on the outer liner whereby the inner liner is pushed outwardly toward the outer liner which distorts and reduces the strength of the corrugated medium. This allows an end flap to be moved between open and closed position as would otherwise be difficult or impossible.

An important factor to point out in connection with score lines is that even though the liners and the corrugated medium have been worked by scoring rollers, the material retains memory, that is to say, it wants to return to the original flat (open) position. Thus, when an end flap is moved from open to closed position and then the moving force relieved, the flap will move up and away from the closed position and, thus, assume an obtuse angle with respect to the panel.

Figure 4:
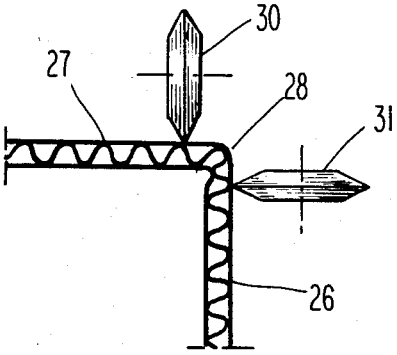
FIG. 4 is a fragmentary view illustrating the conventional way of end flap relaxing.

The inability of a flap to remain in the actual closed position without a holding force applied has required the trade, for automatic palletizing and conveyor transport purposes, to try to reduce the memory so that the end flap would remain closed to the actual closed position. This positioning of the end flaps is referred to in the trade as flap relaxing. The conventional technique for flap relaxing involved the use of scoring or pinching wheels as depicted in FIG. 4 where a carton panel is noted at 26 and its end flap at 27 and the score line at 28. The end flap is placed in the closed position and the wheels 30 and 31 are run along each side of the score line.

The conventional method for flap relaxing has a major disadvantage in that it does not provide end flaps which are close enough to the actual closed position to avoid the palletizing and conveyor problems mentioned heretofore. Moreover, the wheels are set too tight and many cartons are damaged beore the fault is detected and corrected. Also, since the making of the manufacturers joint is not a precision operation, the height and width of cartons will vary and this accentuates the wheel set-up problem mentioned above.

In contrast to the conventional flap relaxing method, the present invention contemplates applying water to wet the outer liner along the score line and on opposite sides of the score line. Usually the wetting takes place about 1" on each side of the score line. This is depicted in FIG. 5 where a carton panel is indicated at 32 and its end flap at 33 and the score line at 34. Water is preferably applied by a conventional bi-axial spray gun. The water spray is indicated at 35 and applies water on the outside of the carton to the outer liner comprising the score line 34 and the areas 36 and 37 respectively on the panel 32 at the end flap 33. These areas 36 and 37 extend about 1" beyond the score line. The preferred cross-sectional pattern of the spray 35 is elliptical as noted at 35*a* in FIG. 5-A.

As observed in connection with FIG. 5, the end flap 33 is in open position. This is preferred, however, the water may be applied with The end flap in closed position. This is illustrated in FIG. 6 where the carton panel is indicated at 40, the end flap in closed position at 41, and the score line at 42. A spray 43 is applied on the outside of the carton to the outer liner comprising part of the score line 42 and the adjacent area at 49 on the panel. A spray 45 is applied on the outside of the carton to theouter liner comprising part of the score line 42 and the adjacent area 46 on the end flap 41.

The elliptical spray pattern on the panel and on the end flap are depicted at 43*a* and 45*a* in FIG. 6-A. It will be seen that the two patterns effectively cover the score line 42.

With double and triple wall cartons, it is usually necessary to apply water to the inside liner as well as to the outside liner. This is depicted in FIG. 7 where the carton panel is indicated at 50, the major end flap at 51, and the score line at 52.

The minor end flap 53 is shown in closed position. The outside spray 54 is the same as the spray 35 of FIG. 5. The inside spray is indicated at 55. With the minor end flap 53 in closed position the inside spray 55 wets the area 56 of the inside liner opposite to the score line 52 and the area 57 opposite to the corresponding outside area on flap 51. The minor flap 53 may be in the open position and in that case, the spray 55 is oriented the same as the spray 54 and wets the inside liner area opposite to the outside area wet by spray 54.

With respect to applying the outside spray this is preferably done with the spray nozzle stationary and with the carton moving past the spray gun. As to spraying inside, the spray gun is mounted so that it is moveable vertically to clear the end flaps and be positioned for the inside spraying described above.

The movement of the end flaps from open to closed position is effected by conventional flap closing equipment.

After the material is wet as above described, the same is subjected to heat sufficient to dry the same. During application of the heat, it is essentail that the flap being relaxed by held in the closed position. So after the spray is applied, the flap being relaxed is placed and maintained in closed position. This condition is in FIG. 8 for the panel 60 and end flap 61 to be relaxed. The panel is bent on the score line 62. Heat is preferably applied by an elongated bar or similar mechanism. As noted in FIG. 10, the bar 63 is L-shaped and carries heater elements along its length. The bar is preferably mounted to move along a 45° angle toward and away from the score line area of the score line 62. When the bar contacts the panel end flap pressure is applied to insure rapid heat transfer.

This bar is several times the length of the score line of the longest end flap to be processed. This permits the heat application to be sequential. For example, when the bar is three times the length, a carton is positioned in front of say a ⅓ area of the heater bar and the heater bar moved into contact with the board and heat applied. The bar is then removed, the carton moved into the next ⅓ area, and the bar moved in and heat again applied. The bar is again moved away, the carton positioned in front of the remaining ⅓ area and the heat applied for the third time.

While sequential application of heat is not essential to effect drying, it is preferred from the standpoint of the operation of automatic machines.

The foregoing description of the wetting process covered wetting in the score line area and in the adjacent area on opposite sides of the score line.

The application of water to these areas is preferred because it insures the desired amount of wetness in the shortest time which is advantageous from the standpoint of maximizing the number of carton conditions as previously mentioned. The area over the score line may only receive the water but this should be done at a rate at which will produce the necessary wetness. The test for the latter, of course, being whether the relaxed flap will remain in substantially closed position after the heat application.

With the above in mind, one general configuration of equipment for practicing the invention will be commented on in connection with FIGS. 9 and 10.

The machine illustrated in FIGS. 9 and 10 may be used by bottle manufacturers involved in the inverted carton packing procedure. When employed by a bottle manufacturer, the machine is disposed between the output of the case packer and the input to the automatic palletizing equipment to provide cartsons with relaxed end flaps eliminateing the palletizing problem mentioned heretofore.

Thus, referring to the maching 64 in FIG. 9, cartons with top flaps open and carrying inverted bottles are delivered to the left hand side 65 of the machine by conveyor means not shown. The cartons go through the machine from left to right and are then discharged to the palletizing equipment. Normally, this will include a case inverter at the discharge side 66 which can be activated to invert the cartons for the top tier on the pallet.

The machine 64 has a frame structure 70 mounting the spray means 71, the flap tucker means 72, and the heater means 73. These components are mounted on a carrier 74 slideabley mounted on the frame for vertical positioning which can be done by the hand crank 75 which rotates threaded shafts operating in nuts on the carrier 74. The vertical adjustment is to accomodate cartons of varying height.

The spray means 71 comprises a pair of spray guns one of which is noted at 80. The flap tucker means 72 includes fixed minor lead flap tucker 81, a pivoting minor rear flap tucker 82, the major flap holder 83, and pivoting major flap tucks 84 and hold down flap 85. The holder 83 is simply to maintain the major flaps open when the water application and minor flap tucking are occuring simultaneously. The heater means 73 comprises the heater bars 86 and 87 which are of the same construction as bar 63 previously mentioned.

The spray guns and the heater bars are independently supported on trolley sliders mounted at carrier 74 for motion toward and away from the center of the machine. This is to accomodate cartons of different widths.

Referring to FIG. 10, heater bar 86 is mounted on trolley 90 which has drive means 91 to move the bar at 45° for reasons previously explained. Heater bar 87 is mounted on identical means. The bar and trolley are moved by hand wheel 92 which rotates threaded shafts operating in nuts on the trolleys. The spray guns have similar trolley arrangements (without the drive means 91).

Below the spray means 71 and the flap tucker means 72, is a continuously moving conveyor 92. Below the heater means 77 is an intermittently operated conveyor 93. The conveyors have appropriate side rail means indicated at 94 and 95.

The general operation of the machine 64 in carrying out the steps of the method will now be described.

Cartons delivered to the input end 65 are disposed on conveyor 92 and engage the stop means 96. At the appropriate time, the stop means is disengaged from the carton and the conveyor 92 begins to move the carton between the spray guns which begin to apply water as previously described. At this time, the rear tucker 82 is up out of the way of the minor flaps. As the carton continues to move, (the spray also continues) and the lead minor flap engages the tucker 81 and begins to be moved to closed position and as the lead minor flap engages bar 85, it is cammed down to closed position. Then the rear tucker 82 is activated to begin to move the rear minor flap to closed position. When the rear minor flap engages the bar 85, it is also cammed down to closed position. At this point, the spray has been completed and is shut off. Now a pair of major flap fold-down bars 84 are engaged by the major flaps and the same are gradually pushed down into substantially closed position. At this point, the heater bars 86 and 87 have been moved away from the carton-heat position (FIG. 10). The carton, with all flaps down, is delivered to the conveyor 93 which positions the carton under the heater bars. When the carton is fully under the heater bars, the conveyor 93 is stopped and the heater bars 86 and 87 brought into engagement with the top edge and applies heat to the wetted areas. Subsequently the bars are pulled back, the carton advances, and the bar is brought in for another application of heat. This process may be repeated several more times.

In the meantime, of course, cartons are delivered to the end 65 and processed as previously described.

In connection with the above description, it is pointed out that conveyor 93 need not be power driven. The conveyor may be the conventional roller type. With such conveyor, the finished carton under the heater bars 86 and 87 is pushed onto the roller conveyor (when the heater bars are moved away) by the next succeeding carton.

Some typical examples of temperature application times and number of applications for successful drying (and leaving the flap in substantially closed position) are noted following. For a separate application of a single thickness carton: three separate applications at 400° F. and lasting three seconds each. For a double wall carton: five applications at 430° F. for three seconds each. When the outer liner may have a special coating for aethetic purposes, the temperature may be reduced, the time increased, and the number of applications increased.

As previously mentioned, the above machine is used in connection with palletizing in the inverted carton packing process. The method is practiced in the pack and seal system by integrating the spray means and heater means into the case erector. In these machines, the cartons are erected with bottom flaps up and open and top flaps down and open. These cartons are fed so that the top flaps are relaxed by feeding the cartons past the spray means and then into the heater means.

When it is desired to place both the minor and major flaps in closed position prior to the application of the water, the flap tucking mechanism is located before the carton is fed to the spray means.

In conclusion, the theory which we believe explains the successful flap relaxing in brief discussion. When the carton liner paper is being made, it is in "sheet" form supported on felt. The "sheet" is very wet and the fibers are not joined so the sheet is not self-supporting (hence, the supporting on a felt sheet). The felt allows the water to drip through. Subsequently, the sheet is calendared which causes the "sheet" to become dry and the fibers joined and the sheet self-supporting. We believe our wetting step causes the fibers of the wet material to become unjoined so to speak. Thus, when the water is driven off the fibers are joined again but in an angled condition (corner) rather than in a flat condition. Wetting apparently does not completely enjoin the fibers and this is highly desirable. Otherwise, when the flaps were dried in the closed position, they would be very difficult to open as is necessary by fillers in both the inverted carton packing and pack and seal systems.

For relaxing at least a pair of opposite end flaps on a four panel, corrugated carton, the invention may be practiced according to the several examples set forth in paragraphs (a)–(i) below.

(a) Providing a four panel corrugated carton with a first pair of opposite end flaps and a second pair of opposite end flaps on at least one side of the carton; applying water on at least the outside of the carton to at least the material on the outer liner comprising at least the score lines respectively of one pair of end flaps in sufficient quantity that said material is wet at least through the outer liner; and while said wet condition remains and while both said first and second end flaps are in substantially closed position, raising the temperature of said wet material sufficiently to cause the material to become substantially dry and then terminate said raising of the temperature whereby each of said one pair of end flaps assumes a substantially closed position subsequent to said termination.

(b) Providing a four panel corrugated carton with a first pair of opposite end flaps and a second pair of opposite end flaps on at least one side of the carton; applying water on the outside of the carton to at least the material on the outer liner comprising at least the score lines respectively of one pair of end flaps in sufficient quantity that said material is wet at least through the outer liner and applying water on the inside of the carton to at least the material of the inner liner opposite said score line in sufficient quantity that last said material of the inner liner opposite said score line is wet at least through the inner liner; while said wet condition remains and while both said first and second end flaps are in substantially closed position, raising the temperature of said wet material sufficiently to cause the material to become substantially dry and then terminate said raising of the temperature whereby each of said one pair of end flaps assumes a substantially closed position subsequent to said termination.

(c) Providing a four panel corrugated carton with a first pair of opposite end flaps and a second pair of opposite end flaps on at least one side of the carton; applying water on at least the outside of the carton to at least the material on the outer liner comprising the score lines respectively of one pair of end flaps and the material of the outer liner on opposite sides of and adjacent to said score lines in sufficient quantity that said material is wet at least through the outer lines; and while said set condition remains and while both said first and second end flaps are in substantially closed position, raising the temperature of said wet material sufficiently to cause the material to become substantially dry and then terminate said raising of the temperature whereby each of said one pair of end flaps assumes a substantially closed position subsequent to said termination.

(d) Providing a four panel corrugated carton with a first pair of opposite end flaps and a second pair of opposite end flaps on at least one side of the carton in open position; maintaining said second pair of end flaps in open position and applying water on the outside of the carton to at least the material on the outer liner comprising at least the score lines respectively of said second pair of end flaps in sufficient quantity that said material is wet at least through said outer liner; while said wet condition remains, placing each of said second pair of end flaps in substantially closed position; prior to placing each of said second pair of end flaps in said substantially closed position, placing said first pair of end flaps in substantially closed position; and while said wet condition remains and while maintaining said second pair of end flaps in said substantially closed position, raising the temperature of said wet material sufficiently to cause the material to become substantially dry and then terminate said raising of the temperature whereby each of said second pair of end flaps assumes a substantially closed position subsequent to said termination.

(e) Providing a four panel corrugated carton with a first pair of opposite end flaps and a second pair of opposite end flaps on at least one side of the carton in open position; maintaining said second pair of end flaps in open position and applying water on the outside of the carton to at least the material on the outer liner comprising the score lines respectively of said second pair of end flaps and to at least the material of the outer liner on opposite sides of and adjacent to the score lines in sufficient quantity that said material is wet at least through said outer liner; while said wet condition remains, placing each of said second pair of end flaps in substantially closed position; prior to placing each of said second pair of end flaps in said substantially closed position, placing said first pair of end flaps in substantially closed position; and while said wet condition remains and while maintaining said second pair of end flaps in said substantially closed position, raising the temperature of said wet material sufficiently to cause the material to become substantially dry and then terminate said raising of the temperature whereby each of said second pair of end flaps assumes a substantially closed position subsequent to said termination.

(f) Providing a four panel corrugated carton with a first pair of opposite end flaps and a second pair of opposite end flaps on at least one side of the carton in open position; placing both said first pair and said second pair of end flaps in substantially closed position; applying water on the outside of the carton to at least the material of the outer liner comprising thescore lines respectively of said second pair of end flaps and to at least the material of the outer liner on opposite sides of and adjacent to the score lines in sufficient quantity that said material is is wet at least through said outer liner; and while said wet condition remains and while said first and second pairs of end flaps are in said substantially closed position, raising the temperature of said wet material sufficiently to cause the material to become substantially dry and then terminate said raising of the temperature whereby the second pair of end flaps assumes a substantially closed position subsequent to said termination.

(g) Providing a four panel corrugated carton with a first pair of opposite end flaps and a second pair of opposite end flaps on at least one side of the carton in open position; placing both said first pair and said second pair of end flaps in substantially closed position; applying water on the outside of the carton to at least the material of the outer liner comprising the score lines respectively of said second pair of end flaps in sufficient quantity that said material is wet at least through said outer liner; while said wet condition remains and while said first and second pairs of end flaps are in said substantially closed position, raising the temperature of said wet material sufficiently to cause the material to become substantially dry and then terminate said raising of the temperature whereby the second pair of end flaps assumes a substantially closed position subsequent to said termination.

(h) Providing a four panel corrugated carton with a first pair of opposite end flaps and a second pair of opposite end flaps on at least one side of the carton each in open position; continuously moving said carton along an axis and while maintaining said second pair of end flaps in open position apply water to the outside of the carton to at least material of the outer liner comprising the score lines respectively of said second pair of end flaps and to at least the material of the outer liner on opposite sides of and adjacent to the score lines in sufficient quantity that said material is wet at least through said outer liner; while applying said water and the carton continues said movement, placing each of said first pair of end flaps in substantially closed positions; while said wet condition remains and while the carton continues said movement, placing each of said second pair of end flaps in substantially closed positions; and while said wet condition remains and while maintaining said second pair of end flaps in said substantially closed position, cause said carton to move to a stationary position and then apply heat to raise the temperature of the wet material sufficiently to cause the material to become substantially dry and then terminate said raising of the temperature whereby the second pair of end flaps assume a substantially closed position subsequent to said termination.

(i) Providing a four panel corrugated carton with a first pair of opposite end flaps and a second pair of opposite end flaps on at least one side of the carton each in open position; continuously moving said carton along an axis and while maintaining said second pair of end flaps in open position apply water on the outside of the carton to at least material on the outer liner comprising the score lines respectively of said second pair of end flaps in sufficient quantity that said material is wet at least through said outer liner; while applying said water and the carton continues said movement, placing each of said first pair of end flaps in substantially closed positions; while said wet condition remains and while the carton continues said movement, placing each of said second pair of end flaps in substantially closed positions; and while said wet condition remains and while maintaining said second pair of end flaps in said substantially closed position cause said carton to move to a stationary position and then apply heat to raise the temperature of the wet material sufficiently to cause the material to become substantially dry and then terminate said raising of the temperature whereby the second pair of end flaps assume a substantially closed position subsequent to said termination.

We claim:

1. The method of relaxing at least a pair of opposite end flaps on a four panel, corrugated carton comprising the steps of:

providing a four panel corrugated carton with a first pair of opposite end flaps and a second pair of opposite end flaps on at least one side of the carton;

applying water on at least the outside of the carton to at least the material of the outer liner comprising at least the score lines respectively of one pair of end flaps in sufficient quantity that said material is wet at least through the outer liner; and while said wet condition remains and while both said first and second end flaps are in substantially closed position, raising the temperature of said wet material sufficiently to cause the material to become substantially dry and then terminate said raising of the temperature whereby each of said one pair of end flaps assumes a substantially closed position subsequent to said termination.

2. The method of relaxing at least a pair of opposite end flaps on a four panel, corrugated carton comprising the steps of:

providing a four panel corrugated carton with a first pair of opposite end flaps and a second pair of opposite end flaps on at least one side of the carton;

applying water on the outside of the carton to at least the material of the outer liner comprising at least the score lines respectively of one pair of end flaps in sufficient quantity that said material is wet at least throughout the outer liner and applying water on the inside of the carton to at least the material of the inner liner opposite said score line in sufficient quantity that last said material of the inner liner opposite said score line is wet at least through the inner liner;

while said wet condition remains and while both said first and second end flaps are in substantially closed position, raising the temperature of said wet material sufficiently to cause the material to become substantially dry and then terminate said raising of the temperature whereby each of said one pair of end flaps assumes a substantially closed position subsequent to said termination.

3. The method of relaxing at least a pair of opposite end flaps on a four panel, corrugated carton comprising the steps of:

providing a four panel corrugated carton with a first pair of opposite end flaps and a second pair of opposite end flaps on at least one side of the carton;

applying water on at least the outside of the carton to at least the material of the outer liner comprising the score lines respectively of one pair of end flaps and the material of the outer liner on opposite sides of and adjacent to said score lines in sufficient quantity that said material is wet at least through the outer liner; and while said wet condition remains and while both said first and second end flaps are in substantially closed position, raising the temperature of said wet material sufficiently to cause the material to become substantially dry and then terminate said raising of the temperature whereby each of said one pair of end flaps assumes a substantially closed position subsequent to said termination.

4. The method of relaxing at least a pair of opposite end flaps on a four panel, corrugated carton comprising the steps of:

providing a four panel corrugated carton with a first pair of opposite end flaps and a second pair of opposite end flaps on at least one side of the carton in open position;

maintaining said second pair of end flaps in open position and applying water on the outside of the carton to at least the material of the outer liner comprising at least the score lines respectively of said second pair of end flaps in sufficient quantity that said material is wet at least through said outer liner;

while said wet condition remains, placing each of said second pair of end flaps in substantially close position;

prior to placing each of said second pair of end flaps in said substantially closed position, placing said first pair of end flaps in substantially closed position; and while said wet condition remains and while maintaining said second pair of end flaps in said substantially closed position, raising the temperature of said wet material sufficiently to cause the material to become substantially dry and then terminate said raising of the temperature whereby each of said second pair of end flaps assumes a substantially closed position subsequent to said termination.

5. The method of relaxing at least a pair of opposite end flaps on a four panel, corrugated carton comprising the steps of:

providing a four panel corrugated carton with a first pair of opposite end flaps and a second pair of opposite end flaps on at least one side of the carton in open position;

maintaining said second pair of end flaps in open position and applying water on the outside of the carton to at least the material of the outer liner comprising the score lines respectively of said second pair of end flaps and to at least the material of the outer liner on opposite sides of and adjacent to the score lines in sufficient quantity that said material is wet at least through said outer liner;

while said wet condition remains, placing each of said second pair of end flaps in substantially closed position;

prior to placing each of said second pair of end flaps in said substantially closed position, placing said first pair of end flaps in substantially closed position; and while said wet condition remains and while maintaining said second pair of end flaps in said substantially closed position, raising the temperature of said wet material sufficiently to cause the material to become substantially dry and then terminate said raising of the temperature whereby each of said second pair of end flaps assumes a substantially closed position subsequent to said termination.

6. The method of relaxing at least a pair of opposite end flaps on a four panel corrugated carton comprising the steps of:

providing a four panel corrugated carton with a first pair of opposite end flaps and a second pair of opposite end flaps on at least one side of the carton in open position;

placing both said first pair and said second pair of end flaps in substantially closed position;

applying water on the outside of the carton to at least the material of the outer liner comprising the score lines respectively of said second pair of end flaps and to at least the material of the outer liner on opposite sides of and adjacent to the score lines in sufficient quantity that said material is wet at least through said outer liner; and while said wet condition remains and while said first and second pairs of end flaps are in said substantially closed position, raising the temperature of said wet material sufficiently to cause the material to become substantially dry and then terminate said raising of the temperature whereby the second pair of end flaps assumes a substantially closed position subsequent to said termination.

7. The method of relaxing at least a pair of opposite end flaps on a four panel corrugated carton comprising the steps of:

providing a four panel corrugated carton with a first pair of opposite end flaps and a second pair of opposite end flaps on at least one side of the carton in open position;

placing both said first pair and said second pair of end flaps in substantially closed position;

applying water on the outside of the carton to at least the material of the outer liner comprising the score lines respectively of said second pair of end flaps in sufficient quantity that said material is wet at least through said outer liner;

while said wet condition remains and while said first and second pairs of end flaps are in said substantially closed position, raising the temperature of said wet material sufficiently to cause the material to become substantially dry and then terminate said raising of the temperature whereby the second pair of end flaps assumes a substantially closed position subsequent to said termination.

8. The method of relaxing at least a pair of opposite end flaps on a four panel corrugated carton comprising the steps of:

providing a four panel corrugated carton with a first pair of opposite end flaps and a second pair of opposite end flaps on at least one side of the carton each in open position;

continuously moving said carton along an axis and while maintaining said second pair of end flaps in open position apply water on the outside of the carton to at least material of the outer liner comprising the score lines respectively of said second pair of end flaps and to at least the material of the outer liner on opposite sides of and adjacent to the score lines in sufficient quantity that said material is wet at least through said outer liner;

while applying said water and the carton continues said movement, placing each of said first pair of end flaps in substantially closed positions;

while said wet condition remains and while the carton continues said movement, placing each of said second pair of end flaps in substantially closed positions; and while said wet condition remains and while maintaining said second pair of end flaps in said substantially closed position, cause said carton to move to a stationary position and then apply heat to raise the temperature of the wet material sufficiently to cause the material to become substantially dry and then terminate said raising of the temperature whereby the second pair of end flaps assume a substantially closed position subsequent to said termination.

9. The method of relaxing at least a pair of opposite end flaps on a four panel corrugated carton comprising the steps of:

providing a four panel corrugated carton with a first pair of opposite end flaps and a second pair of opposite end flaps on at least one side of the carton each in open position;

continuously moving said carton along an axis and while maintaining said second pair of end flaps in open position apply water on the outside of the carton to at least material of the oute liner comprising the score lines respectively of said second pair of end flaps in sufficient quantity that said material is wet at least through said outer liner;

while applying said water and the carton continues said movement, placing each of said first pair of end flaps in substantially closed positions;

while said wet condition remains and while the carton continues said movement, placing each of said second pair of end flaps in substantially closed positions; and while said wet condition remains and while maintaining said second pair of end flaps in said substantially closed position cause said carton to move to a stationary position and then apply heat to raise the temperature of the wet material sufficiently to cause the material to become substantially dry and then terminate said raising of the temperature whereby the second pair of end flaps assume a substantially closed position subsequent to said termination.

* * * * *